United States Patent [19]

Mathieü et al.

[11] Patent Number: 4,526,242

[45] Date of Patent: Jul. 2, 1985

[54] DRILLING DEVICE

[75] Inventors: Hans Mathieü, Saarbrücken-Bischmisheim; Jürgen Hochstrasser, Saarbrücken, both of Fed. Rep. of Germany

[73] Assignees: Elisabeth Hochstrasser geb. Wack; Jurgen Hochstrasser, both of Fed. Rep. of Germany

[21] Appl. No.: 362,096

[22] Filed: Mar. 26, 1982

[30] Foreign Application Priority Data

Apr. 7, 1981 [DE] Fed. Rep. of Germany ..... 3114612

[51] Int. Cl.[3] ..... E21B 25/10

[52] U.S. Cl. ..... 175/94; 175/99; 175/308; 175/405

[58] Field of Search ..... 173/52; 175/94, 96, 175/99, 107, 122, 308, 309, 311, 293, 296, 404, 405, 161

[56] References Cited

U.S. PATENT DOCUMENTS

| | | | |
|---|---|---|---|
| 2,054,255 | 9/1936 | Howard | 175/404 |
| 2,541,785 | 2/1951 | Smith | 175/405 |
| 3,790,213 | 2/1974 | Grable | 175/107 |
| 4,102,411 | 7/1978 | Webb et al. | 175/320 |
| 4,102,415 | 7/1978 | Cunningham | 175/96 |

FOREIGN PATENT DOCUMENTS

| | | | |
|---|---|---|---|
| 1904684 | 8/1970 | Fed. Rep. of Germany | 175/94 |
| 407295 | of 1944 | Italy | 175/94 |
| 23730 | of 1899 | United Kingdom | 175/405 |

*Primary Examiner*—Stephen J. Novosad
*Assistant Examiner*—William P. Neuder
*Attorney, Agent, or Firm*—Basile, Weintraub & Hanlon

[57] ABSTRACT

A drilling device which can be lowered in a drill hole consists of a drive device, a drill which is rotated by this drive device and a clamping device formed as a unit which can be engaged with the inside wall of the drill hole and serves to transfer the torque of the drive to the drill. The drill consists of a ring-shaped housing, the outside diameter of which corresponds with the diameter of the drill hole and the upper part of is closed off by a plate. The housing contains several cutting tools which are equipped with bore crowns which serve to cut out a drill core and which are arranged at uniform distances and parallel with the longitudinal axis of the drilling device. Using additional drive devices, the cutting tools are designed to impart impact impulses and/or additional rotational movements in an axial direction. All drive devices are fluid actuated in such a manner that the clamping device is actuated initially and the drill is subsequently activated by the increasing pressure of the fluid medium.

9 Claims, 7 Drawing Figures

DRILLING DEVICE

BACKGROUND OF THE INVENTION

I. Field of the Invention

The invention relates to a drilling device which is lowered into a drill hole to be driven into hard stone, particularly rock, and to a process for drilling the hole.

II. Description of the Prior Art

Drilling devices are known which consist of a drive means, a drill which is rotated by the drive means and a clamping device which can be engaged with the internal wall of the drill and/or its pipe wall and serving to transfer the torque of the drive means to the drill and which are connected as a unit and can be fastened to a hoist rope or a drilling linkage with the drill being movable compared with the clamping device by an amount equal to one work stroke in an axial direction to the drill. German Pat. No. 842 932 describes such a drilling device which can execute one work stroke under the influence of its own weight wherein the clamping device via a limited work stroke is guided axially but rotatably along the housing containing the drive motor and carrying a gimlet bit. As a rule, the weight of the drilling device suffices for drilling in a loose soil, possibly containing small sized stones; however, when drilling in hard stone, particularly in bedrock, this weight does not suffice to remove the stone especially if a gimlet bit or a box-shaped drill is equipped with cutters at the bottom. German Published Application No. 27 22 075 shows such a drilling device equipped with a gimlet bit where piston-cylinder elements are arranged between the clamping device and the drive motor of the drill in an axial direction to the drill hole in order to increase the pressure of the drill provided by the weight of the drilling device. This measure only facilitates faster drilling in loose soil, but the device is also unsuited for drilling in bedrock. German Pat. No. 1 171 848 cited in the above-mentioned German Publication is an internal drilling device with a rotary drill drive used with the reverse flushing process where an additional active drill pressure via hydraulic piston-cylinder arrangements is also exerted. For the above-mentioned reasons, this known version is also unsuited for drilling in very hard stone.

German Published Application No. 28 45 878 describes a drilling device for in-ground drilling where the advancing movement of the drilling device is implemented by kellies whereas the rotary movement is caused by a drive motor attached at the lower end of the linkage. This drilling device is intended for general in-ground drilling and represents an improvement compared with the previously known drilling devices of this type where the advance as well as the rotary drive of the drill is transmitted by telescoping kelly rods whereas in accordance with the version of the Published Application the kellies do not participate in the rotary movement since the rotary drive is implemented by the drive motor connected with the drill to form one unit and the drilling linkage is handled by a carrying or support device above the drive hole. In spite of this, it is necessary to install the required linkage from the drilling device to the carrier device for the flush as well as for dry drilling which is rather expensive depending upon depth of the drilling. Another factor is that the augers in a core drill and the roller bits of a drill which removes the entire drilled matter require very high rotary forces for cutting in bedrock so that the necessary linkages must be correspondingly strong and therefore correspondingly expensive.

All of the versions of the above described published applications have the same drawback, namely, that they can be used successfully for drilling in soft to hard and rock soil, but that they can work in medium hard to hard rock only with very low drilling output with high energy expenditure, and that this also can be facilitated only with limited drilling depth.

SUMMARY OF THE INVENTION

Thus, the purpose of this invention is the production of a drilling device and a drilling process permitting high drilling output even in the most difficult rock, employing dry as well as flushed drilling which limit the required huge rotary drives to an economically justifiable measure when employing gimlet drilling and also when removing the entire surface with auger bits when drilling in rock for large bored piles. The new drilling device and the drilling process would improve the drilling devices for dry and flushed drilling operating with core pipes to such an extent that they could also be used for drilling in rock when drilling for large bored piles and other large sized drillings in great to very great depths in a simple and economical manner.

This requirement is met with a drilling device in accordance with the overall definition of the primary claim by means of the properties listed in the description part of the claim.

The secondary claims represent advantageous further developments and versions of the primary claim.

The drill in accordance with this invention consists of a ring-shaped housing in which are arranged several cutting tools equipped with bore crowns arranged at the periphery, which cutting tools impart impact impulses directed against the rock in an axial direction by way of additional drive means and which apply additional rotary movement. The drive output of the drill is concentrated upon the production of a ring gap and the cutter effect of the rotary and/or high speed impact cutters installed at several points of the drill rotating around the drilling axis is so great that drilling is facilitated in a quick and effective manner with relatively low drive energy even in the hardest rock.

Another significant advantage consists of the fact that all activating elements of the drilling devices, namely, the clamping device, the drive means, the pipe-shaped housing and the drive means for the cutting tools, can be activated by one and the same preferably pneumatic pressure medium so that only a single feed line is required for the medium. By the installation of a check valve between the clamping device and the drive means for the pipe-shaped housing of the drill, it is guaranteed that the clamping device is initially activated when applying the compressed air to the combined line at a lower pressure so that the clamping device is set in the drill pipe in the direction of rotation prior to start-up of the drive devices of the drill. When building up complete pressure, the drill is activated and via the hollow linkage in the drilling device the full drilling pressure is simultaneously applied to the clamping device. The compressed air is fed to the clamping device and the individual cutting tools by way of flexible secondary lines so that the drive means of the drill can be lowered as compared with the clamping device in the version according to FIGS. 1 and 2, and that the axial movement of the cutting tools can take place compared with the pipe-shaped housing of the drill in accordance with FIG. 3. The drilling device according to this invention may be used for different bore hole diameters requiring only an exchange of the clamping jaws, the guide wings of the clamping device and the pipe-shaped housing. In order to facilitate this, a removable flange connection is formed in the hollow linkage between the drill and its drive organs. The drive means for the pipe-shaped housing is formed in the manner of a pneumatic drill, whereas the drive means for the cutting tools which are installed in the connecting plate fastened in an air-tight manner to the upper plate of the drill are either formed as pneumatic drills or pneumatic impact drills. In order to support the guide function for the drilling device in the drill hole, it is advantageous to use a cutting tool for producing a pilot drilling. This cutting tool should be centered on the pipe-shaped housing and protrude when compared with the cutting tools attached to the edge of the housing.

The drilling device according to this invention can also be used advantageously in a drilling device equipped with a drilling linkage. In this case the pipe-shaped housing is rotated by the drill stem kelly bushing of the drilling device and the drilling linkage serves as a feed of the pressure medium to the drive means of the cutting tools so that a commonly used drilling device equipped with a drilling linkage may also be used for drilling in rock. In the case of flush drilling, the pressure medium exiting from the cutting tools, namely, compressed air, is used as a flushing medium in order to transfer the drillings into a sediment container installed in the pipe-shaped housing through a ring gap between the ring-shaped housing and the drill hole.

In drilling sloped or horizontal drill holes, it may be appropriate to equip the ring-shaped housing with guide devices, such as guide rollers, roller bearings or the same, at its outer periphery and piston-cylinder arrangements between the clamping device and the ring-shaped housing may be installed in order to support the drilling pressure. Implementing the process according to this invention using the drilling device, a ring gap of predeterminable width and depth corresponding with the outside diameter of the drill hole is initially produced. After removal of the drilling device, the drill core formed in this manner is broken or crushed by way of a cleaving cutter, a feather which may be activated as desired, or by blasting, in which case the pilot drill hole can be used to install the blasting material. After crushing the stone, the parts of the drill core can be removed by way of a grasping tool.

The invention can also be used advantageously with a known dry rotary and flush drilling devices all by simply flanging the drill according to this invention to the lower end of the required drilling linkage with the rotary drive being implemented via the drill linkage which feeds the pressure agent to the cutting tools and the flusing agent for removing the drillings.

BRIEF DESCRIPTION OF THE DRAWINGS

Additional advantages may be derived from the versions of the invention shown in the drawings by way of example. The drawings are explained as follows.

DETAILED DESCRIPTION OF THE INVENTION

Figure 1:
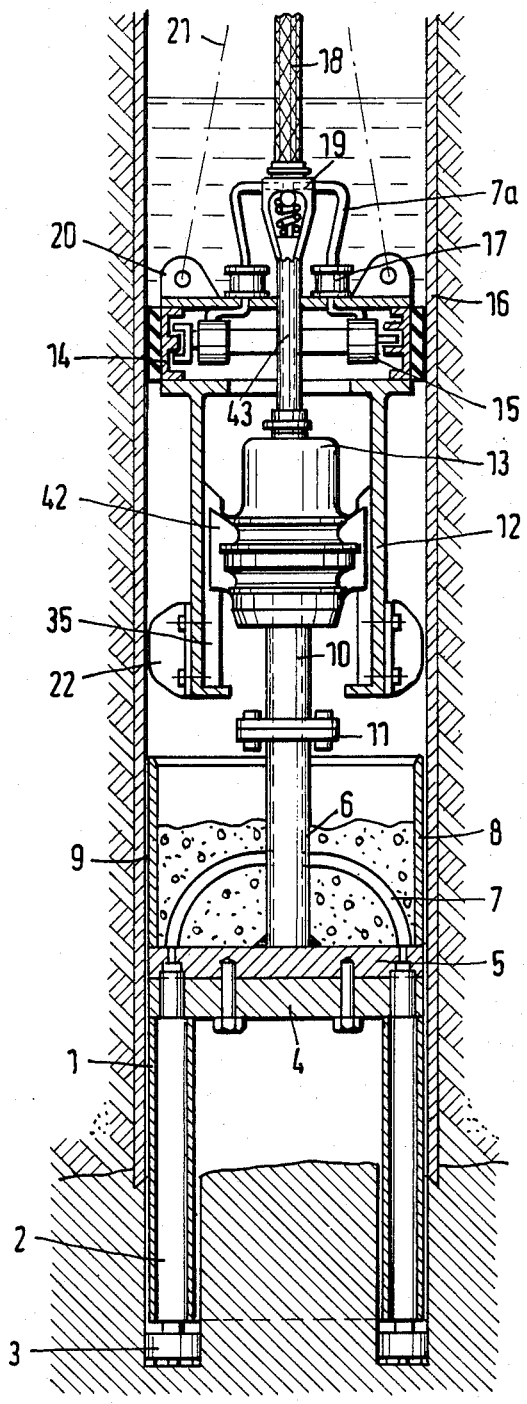
FIG. 1 is a cutaway schematic illustration of the drilling device lowered into the drilling pipe by way of a crane cable.

FIG. 1 shows the drilling device in operating position after having been lowered into the drilling pipe 16 of a drill hole. The device is equipped with a drill consisting of a pipe-shaped, ring-type housing 1 adjusted to the diameter of the drill pipe 16 in which a number of cutting tools 2 are installed in an axial direction which are equipped with crowns 3 and which are preferably formed as rotary or impact cutters. The pipe-shaped housing 1 has an upper plate 4 through which protrude the cutting tools 2. Attached to plate 4 in an air-tight manner is connecting plate 5 to which a vertical, hollow shaft 6 is fastened. From this hollow shaft, secondary lines 7 lead to the drive means of the cutting tools 2 located in connecting plate 5. A removable sediment container 8 is located on connection plate 5. Located between the pipe-shaped housing 1 and sediment container 8 is a ring gap through which the drillings are transferred into sediment container 8 by means of flushing. By way of a flange 11, the hollow shaft 6 is connected with the hollow drive shaft 10 of drive means 13 to which compressed air is fed via compressed air line 18 and a tube 43 and through which the pipe-shaped housing 1 can be rotated. Above the drive means 13 a clamping device is installed which consists of a housing 12 which contains clamping jaws 14 which can be engaged with the drill pipe 16 via piston-cylinder arrangements 15. Converters 17 are installed on the housing 12 which are fed from the compressed air line 18 via branch lines *7a*. Below branch lines *7a* a check valve 19 is installed in the pipe 43. On the top of the housing 12 lift hooks 20 are installed in which a cable suspension tackle 21 is fastened. Wings 22 which are directed toward the outside are distributed over the periphery of the pipe-shaped housing 12 of the clamping device which serve to guide the clamping device in the drill pipe 16. The housing 12 contains the drive means 13 for the pipe-shaped housing 1 in a movable fashion. The drive means 13 is formed as the drill and flush head. Fastened to the internal surface of the housing 12 are guide strips 35 which are distributed over the entire periphery and point to the inside. Drive means 13 is equipped with guide wings 42 by which the housing of drive means 13 is safeguarded against rotation but can be moved in an axial direction.

The mode of operation of the drilling device is described in the following.

Figure 2:
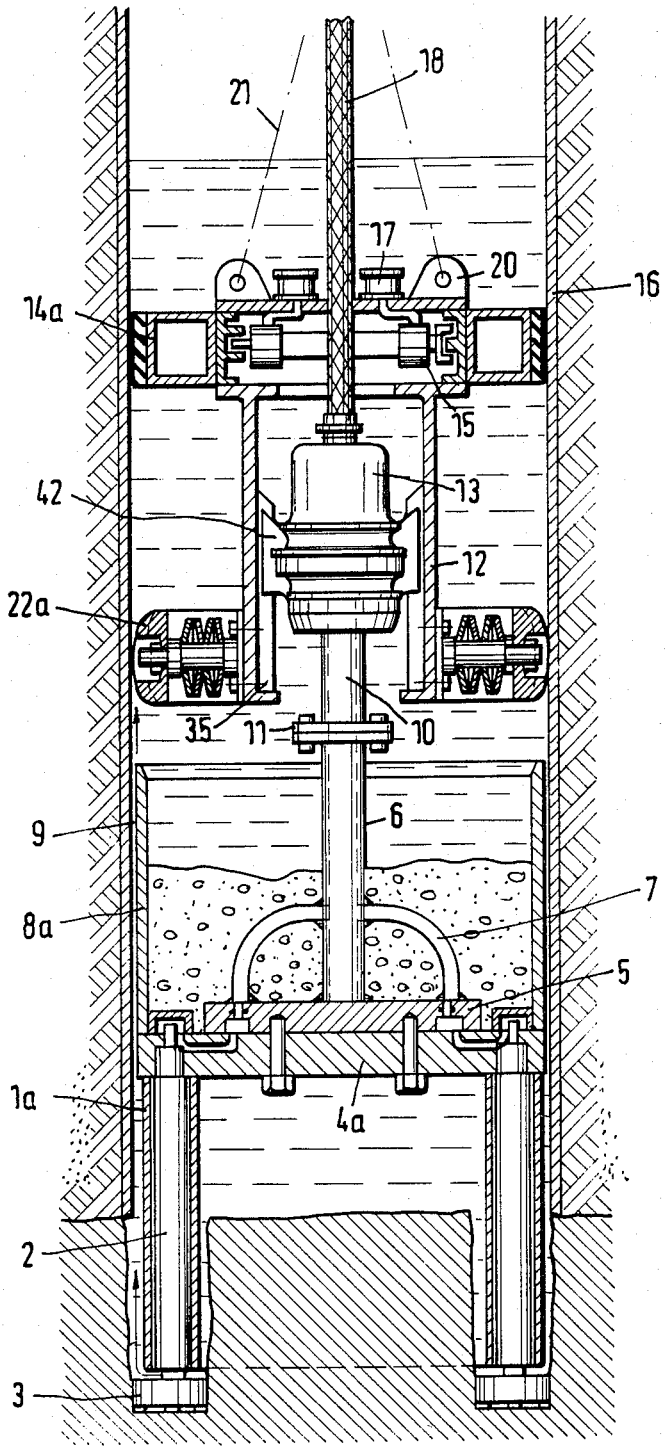
FIG. 2 is an illustration according to FIG. 1 with a larger diameter drill pipe.
Figure 4:
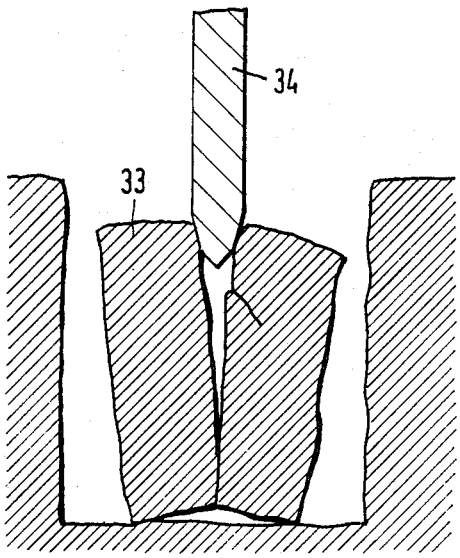
FIG. 4 is an illustration of the crushing of the drill core remaining in the bore hole.

The device consisting of clamping device 14, 15, 12 and drive means 13 and the pipe-shaped housing 1 is lowered to the bottom of the drill hole using cable suspension tackle 21 so that the entire device sits on the bottom of the drill hole. At this point compressed air is fed into compressed air line 18, resulting in a buildup of compressed air. At the beginning of this process, the check valve 19 is kept in a closed position by a spring so that the compressed air under low pressure is fed into converters 17 through feed lines 18. Being connected with an oil reservoir which is not illustrated, the converter 17 supplies the pressure causing the clamping jaws 14 to be pushed against drill pipe 16. With increasing air pressure, check valve 19 opens causing the air pressure in the piston-cylinder arrangements 15 of clamping jaws 14 to increase. Simultaneously air pressure is applied to drive means 13 and via hollow shafts 10, 6 through lines 7 to the drive means of cutting tools 2 installed in the pipe-shaped housing 1 so that the pipe-shaped housing 1 and the cutting tools 2 are activated and drill a ring-shaped channel in the rock. The spent air of the cutting tools 2 creates a rising stream of flushing air in the ring gap 9 as shown in FIG. 2 by an arrow. This airstream transports the drillings upwards and deposits them in the sediment container 8. The drillings in the sediment container 8 further increase the drilling pressure over and above the weight of the device, thus promoting the drilling process. After drilling the ring-shaped gap in the rock, the drilling device is pulled out of the drill pipe 16 by way of the cable and, as is shown in FIG. 4, the rock core 33 is broken down by means of an impact cutter 34 whereupon parts of the rock core are removed from the drill hole by way of a grasping device. Following this process, the drilling device is again lowered into the drill pipe 16 and the drilling process is repeated.

FIG. 2 corresponds with FIG. 1 with the difference that the drill hole equipped with a drill pipe having a larger diameter. The drilling device corresponds with the drilling device shown in FIG. 1 in which a pipe-shaped housing 1*a* is adjusted to the diameter of the drill hole. Guide wings 22*a* and clamping jaws 14*a* on the housing 12 of the clamping device are adjusted to the diameter of the drill pipe 16. All other parts of the drilling device are unchanged so that only the above referenced parts must be replaced. For this purpose, these parts are constructed in such a manner that they can be quickly and reliably exchanged at the construction site. The check valve 19 is eliminated in FIG. 2.

Figure 3:
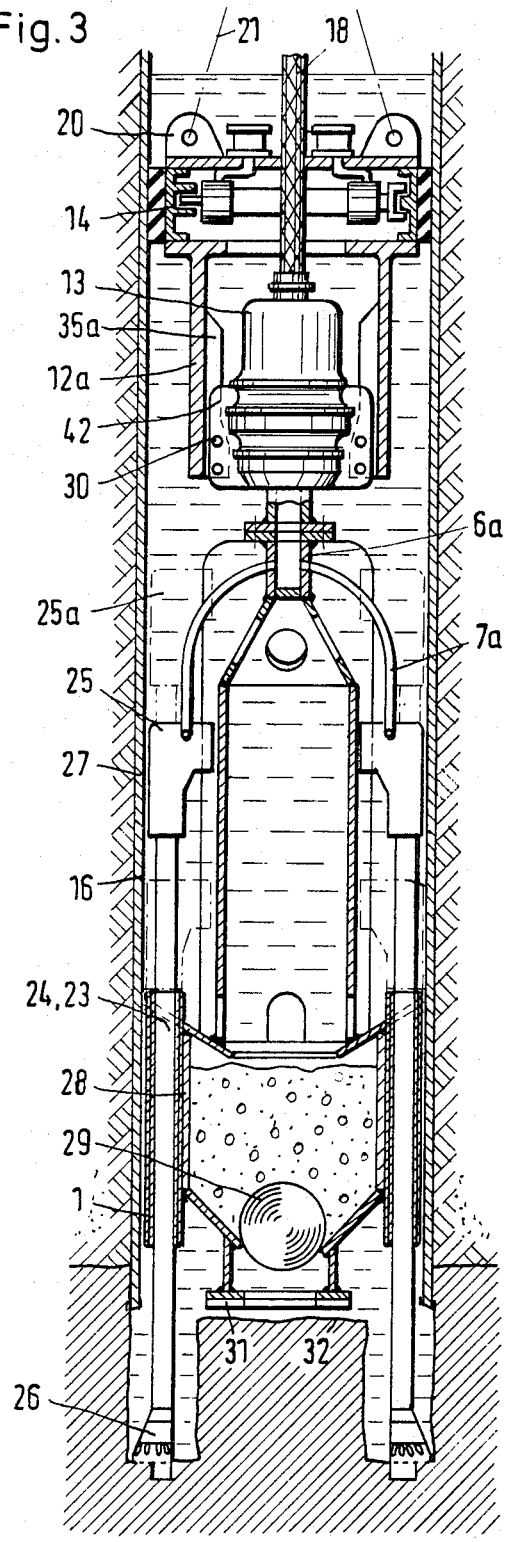
FIG. 3 is an illustration according to FIG. 1 of an altered version of the present invention.

FIG. 3 shows a different version of the drilling device from that shown in FIG. 1. The change primarily consists of a different version of the drill. The pipe-shaped housing 1 containing the cutting tools 23, 24, which are designed as rotary and impact drills, has a centered set down ring 31 which is placed against the floor of the drill hole and adjacent to the sediment container 28 which can be closed off with a ball 29 and a subsequent carrying container 27 which has a smaller diameter than the sediment container 28. The cutting tools 23, 24 are movable in a longitudinal direction and are installed in the pipe-shaped housing 1 which contains the sediment container 28 and have at their free ends a ring-shaped housing 25 which contains the drive means for the cutting tools 23 and 24. The housing 25 is connected with the linkage 6*a* via flexible lines 7*a*. The drive means 13 of the pipe-shaped housing is solidly connected with strips 35*a* of the housing 12*a* of the clamping device 14, 12*a* which serve to guide the drive means. The crowns 26 of the cutting tools 23, 24 are formed in a conically expanding manner undercutting the drill pipe 16 and the drill hole and have a flat spot on one side which is in alignment with the surface of the cutting shaft, and the conical or screw-shaped surfaces of the crowns 26 form a guide surface which, upon engagement with the drill pipe 16, rotates the crowns 26 in such a manner that their flat point is turned towards the drill pipe 16.

The rotary drive for the pipe-shaped housing 1 is facilitated via the carrying container 27 and the hollow linkage 6*a* which also serves as a feed for the pressure medium for the drives of the cutting tools 23, 24 installed in housing 25 via feed lines 7*a* and thus also as a feed of the compressed air serving as the flushing medium.

By way of the guide strips 35*a* through screws 30 protruding through guide wings 42, the drive means 13 of the carrying container 27 shaped as a rotary and flushing head is set in an axial direction. The mode of operation of this drilling device is as follows:

To begin with, the drilling device is placed in a non-illustrated guide pipe at the construction level preferably with a set down ring 31 which is cushioned with an elastic plastic material, with the housing 25 carrying the cutting tools 23, 24 being in the upper position 25*a* which is identified by dash-dot lines and the drill crowns 26 being in their highest, non-illustrated position above the set down ring 31. The hoist cable is fastened to the suspension tackle 21. The drilling device is picked up and lowered into the drill pipe 16 until the set down ring 31 comes in contact with the rock bottom 32. At this point the drilling device is lifted by approximately 2–5 centimeters and the clamping jaws 14 are clamped in the above described manner with the aid of the piston-cylinder arrangement 15. The ball valve 19 which is required for this maneuver is not shown. As soon as a corresponding pressure, approximately 3 bars, has built up in the compressed air line 18, check valve 19 opens and the drive means 13 begins to rotate the carrying container 27 and thus the pipe-shaped housing 1 around the drill axis, and compressed air which also serves as the flushing medium is admitted to the drive means installed in housing 25, as described above for FIG. 1.

The drilling advance of housing 25 may be increased for instance by spring force or by weights. Normally, however, the weight of housing 25 itself including the cutting tools 23, 24 and the drilling crowns 26 will suffice. The upward lift of housing 24 for instance is implemented by a pneumatic cylinder or with the aid of a second hoist cable, neither of which are illustrated.

Figure 5:
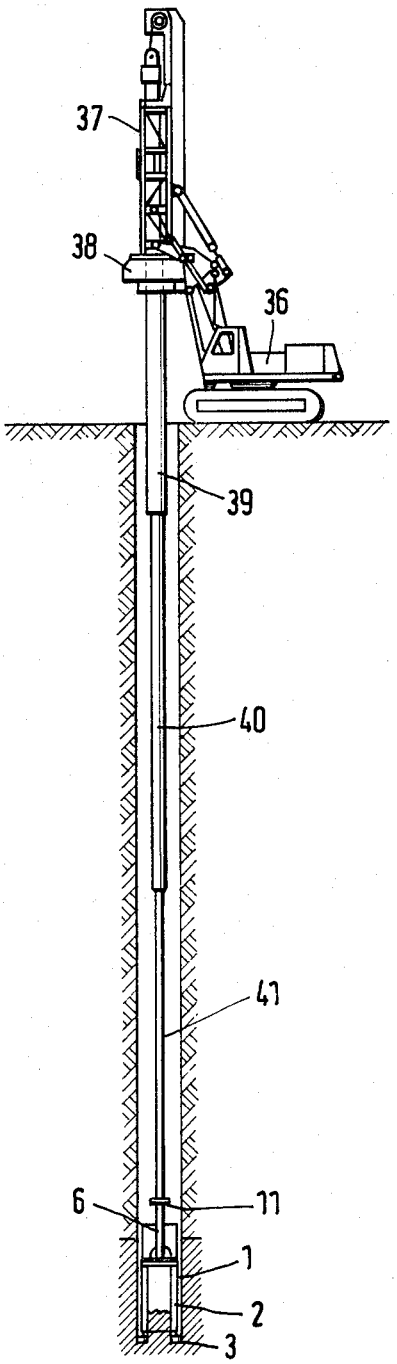
FIG. 5 is a schematic illustration of a drilling device equipped with a drilling linkage, with the drill attached to the linkage.

FIG. 5 shows the overall arrangement of a known drilling installation. A vehicle 36 is equipped with a lattice pole with an intermediary 37 and a drill stem kelly 38. Via the telescoping kelly linkage 39, 40, 41 and via flange 11 and the hollow linkage 6, the rock drill with its ring housing 1 is driven and the cutting tools 2 receive the compressed air and flushing agent feed, as is shown in FIG. 1. The drill is lowered and raised into and out of the drill hole using the telescoping kelly linkage 39, 40, 41.

Figure 6:
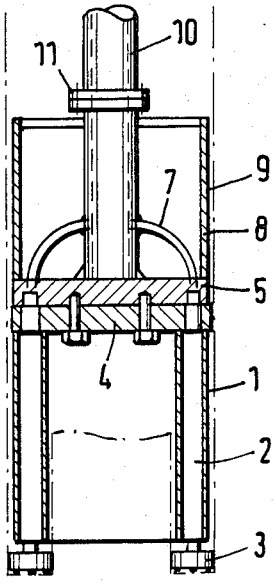
FIG. 6 is a cutaway, enlarged illustration of the drill showing its connection flange to the drilling linkage.

FIG. 6 shows the rock drill according to FIG. 5 on an enlarged scale. This application example shows the particularly advantageous use of the same rock drill as part of the drilling device according to FIG. 1 using a known rotary drilling device. This version is used advantageously particularly for drilling which is not too deep in medium hard to very hard rocks.

Figure 7:
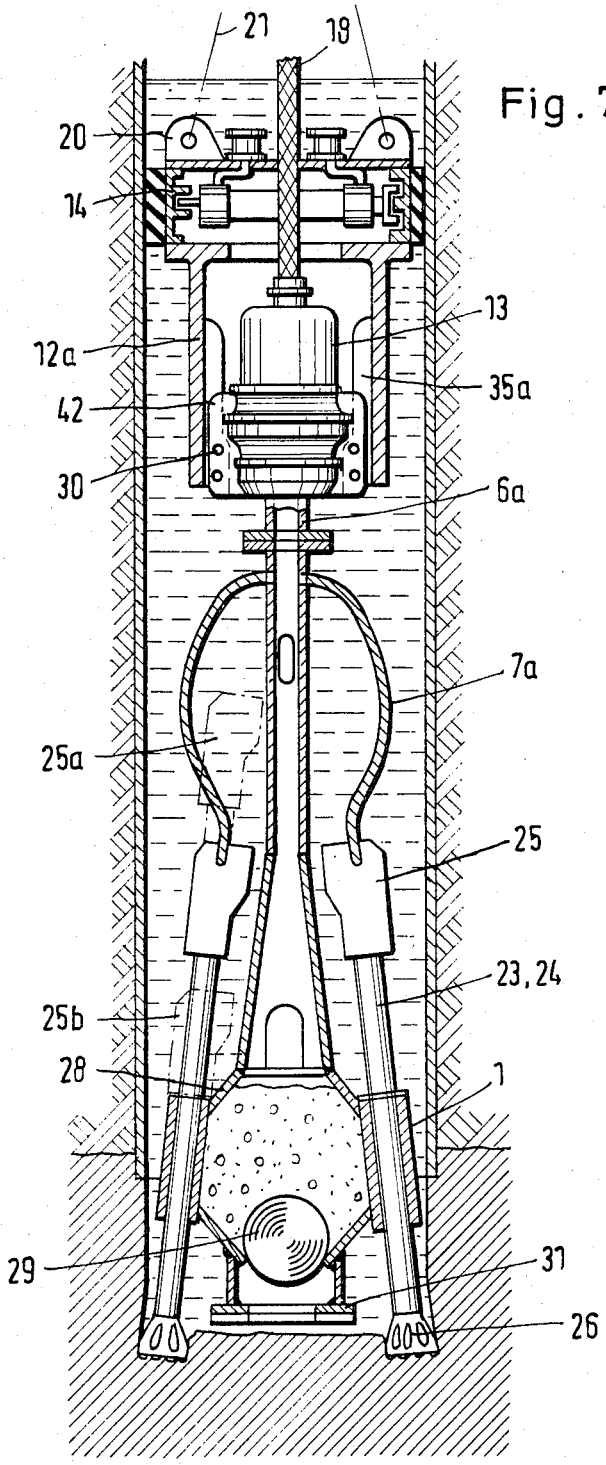
FIG. 7 is an altered version of FIG. 3 where the cutting tools are arranged in an outwardly sloping diverging manner in order to facilitate widening of a drilled hole.

FIG. 7 shows an altered version of the drilling device shown in FIG. 3 in which the cutting tools 23, 24 are arranged in an outwardly diverging manner in order to produce an expanded drill hole which is required when the concrete poles should have a reinforced footing.

For drilling the cylindrical part of the bore hole, a drill as shown in FIG. 3 is used. If the drill hole is to be expanded for instance for a reinforced footing of the concrete pole, the drill shown in FIG. 7 is connected with drive means 13 instead of the drill shown in FIG. 3, and the device is lowered to the bottom of the drill hole, during which process the cutting tools 23 and 24 are in position 25*a*, which is indicated by a broken line. After lowering to the bottom of the drill hole, the drill is started up as described for FIG. 3 by way of drive means 30, during which process the cutting tools 23 and 24 work a conically expanding ring gap into the rock when reaching position 25*b*, which is indicated by a broken line corresponding with their tilt. After cutting the ring gap, cutting tools 23 and 24 are withdrawn into position 25*a* and the drilling device is pulled out of the drill hole, after which the conically expanding core is crushed and removed in the normal manner. When the drill hole is filled with concrete, the resulting concrete pole will have an enlarged footing.

The drill according to this invention is considerably more advantageous when compared with known drills when the following reasons are taken into consideration. As a result of the high specific effect of the cutting tools 2, 23 and 24, an economically justifiable drill speed is achieved even in rock which otherwise requires relatively slow drilling or which cannot be penetrated by drilling at all.

Because the drill is guided well within the drill pipe and as a result of the high specific cutting effect, relatively well, also diagonally dipping rock zones can be drilled which are generally considered as being very difficult.

Contrary to known devices, the drilling device with the clamping device according to this invention facilitates rock drillings in essentially any type of rock at very great depths since the device is lowered into the drill hole on a wire cable and since only a compressed air line 18 must be lowered to the drilling site. The compressed air line supplies the various drive means as well as the control system and serves to supply the flushing medium. Another advantage of the invention consists of the fact that existing rotary and flush drilling devices can be used essentially unaltered with a rock drill according to FIGS. 5 and 6 utilizing all advantages with the exception of the essentially unlimited drilling depth.

The drilling device according to this invention with unaltered clamping device, an unaltered rotary and flushing heads may also be used for the operation of existing core barrels and roller bits at essentially unlimited drilling depths, further increasing the economical application of this invention.

We claim:

1. A drilling device which may be lowered into a drilled hole to be driven into hard stone, particularly rock, consisting of a drive means, a drill which is rotated by the drive means and a clamping device which engagable with the inside wall of the drilled hole and/or the inside wall of the piping, and which serves to transfer the torque of the drive means to the drill wherein the drive means, the drill and the clamping device are connected as one unit which may be fastened to the cable of a hoist or a drilling linkage with the drill being axially movable relative to the drilling pipe over a range corresponding with one working stroke and contrary to the clamping device characterized in that the drill comprises a ring-shaped housing (1), the outside diameter of which corresponds with the diameter of the drilled hole, a top plate, several cutting tools (2,23,24) installed in the top plate at equal distances from each other, parallel with the longitudinal axis of the drilling device, and serving to free a drilling core and bore crowns (3,26) mounted on the cutting tools which produce impact impulses in an axial direction and/or additional rotary movement by way of additional drive means, the clamping device (12,14), the drive means (13) for the pipe-shaped housing and the additional drive means for the cutting tools (2,23,24) being activated by a mutual fluid medium, and a check valve (19) which prevents simultaneous activation of the clamping device and the drive means for the housing being installed between the clamping device (12,14), the drive means for the housing (1) and the drive means for cutting tools (2,23,24) in the line containing the fluid medium (18).

2. The drilling device in accordance with claim 1 characterized in that the clamping device (12,14), the drive means (13) for the pipe-shaped housing (1) and the pipe-shaped housing (1) are connected by a hollow linkage (6,10) into which the fluid medium can be fed through a line (18) or through the drilling linkage (39,40,41), and that flexible feeds (7,7*a*) for carrying the fluid medium for activating the cutting tools (2,23,24) and the clamping device (12,14) are installed on the hollow linkage (6,10).

3. A drilling device which may be lowered into a drilled hole to be driven into hard stone, particularly rock, consisting of a drive means, a drill which is rotated by the drive means and a clamping device which is engagable with the inside wall of the drilled hole and/or the inside wall of the piping, and which serves to transfer the torque of the drive means to the drill wherein the drive means, the drill and the clamping device are connected as one unit which may be fastened to the cable of a hoist or a drilling linkage with the drill being axially movable relative to the drilling pipe over a range corresponding with one working stroke and contrary to the clamping device characterized in that the drill comprises a ring-shaped housing (1), the outside diameter of which corresponds with the diameter of the drilled hole, a top plate, several cutting tools (2, 23, 24) installed in the top plate at equal distances from each other, parallel with the longitudinal axis of the drilling device, and serving to free a drilling core and bore crowns (3,26) mounted on the cutting tools which produce impact impulses in an axial direction and/or additional rotary movement by way of additional drive means; and a connecting plate (5) connected with a bottom plate (4) of the pipe-shaped housing (1) in an airtight manner, the connecting plate (5) including fastening means for the cutting tools which are connected with a fluid medium flowing in a hollow linkage (6,10) via feed connections (7).

4. A drilling device which may be lowered into a drilled hole to be driven into hard stone, particularly rock, consisting of a drive means, a drill which is rotated by the drive means and a clamping device which engagable with the inside wall of the drilled hole and/or the inside wall of the piping, and which serves to transfer the torque of the drive means to the drill wherein the drive means, the drill and the clamping device are connected as one unit which may be fastened to the cable of a hoist or a drilling linkage with the drill being axially movable relative to the drilling pipe over a range corresponding with one working stroke and contrary to the clamping device characterized in that the drill comprises a ring-shaped housing (1), the outside diameter of which corresponds with the diameter of the drilled hole, a top plate, several cutting tools (2,23,24) installed in the top plate at equal distances from each other, parallel with the longitudinal axis of the drilling device, and serving to free a drilling core and bore crowns (3,26) mounted on the cutting tools which produce impact impulses in an axial direction and/or additional rotary movement by way of additional drive means, the housing (12) containing diametrically opposed strips directed toward the inside, safeguarding the housing of the drive means (13) against rotation.

5. A drilling device which may be lowered into a drilled hole to be driven into hard stone, particularly rock consisting of a drive means, a drill which is rotated by the drive means and a clamping device which engagable with the inside wall of the drilled hole and/or the inside wall of the piping, and which serves to transfer the torque of the drive means to the drill wherein the drive means, the drill and the clamping device are connected as one unit which may be fastened to the calbe of a hoist or a drilling linkage with the drill being axially movable relative to the drilling pipe over a range corresponding with one working stroke and contrary to the clamping device characterized in that the drill comprises a ring-shaped housing (1), the outside diameter of which corresponds with the diameter of the drilled hole, a top plate, several cutting tools (2,23,24) installed in the top plate at equal distances from each other, parallel with the longitudinal axis of the drilling device, and serving to free a drilling core and bore crowns (3,26) mounted on the cutting tools which produce impact impulses in an axial direction and/or additional rotary movement by way of additional drive means, the clamping jaws (14), the wings (22) and the ring-shapoed housing (1) with the sediment container (8) are exchangeable in order to adjust the device to drill holes with various diamters.

6. A drilling device which may be lowered into a drilled hole to be driven into hard stone, particularly rock, consisting of a drive means, a drill which is rotated by the drive means and a clamping device which engagable with the inside wall of the drilled hole and/or the inside wall of the piping, and which serves to transfer the torque of the drive means to the drill wherein the drive means, the drill and the clamping device are connected as one unit which may be fastened to the cable of a hoist or a drilling linkage with the drill being axially movable relative to the drilling pipe over a range corresponding with one working stroke and contrary to the clamping device characterized in that the drill comprises a ring-shaped housing (1), the outside diameter of which corresponds with the diameter of the drilled hole, a top plate, several cutting tools (2,23,24) installed in the top plate at equal distances from each other, parallel with the longitudinal axis of the drilling device, and serving to free a drilling core and bore crowns (3,26) mounted on the cutting tools which produce impact impulses in an axial direction and/or additional rotary movement by way of additional drive means, the bore crowns (26) of the cutting tools (2) formed as rotary or rotary-impact drills (23 and/or 24) are shaped in a conically expanding manner undercutting the drill pipe (16) of the drill hole and are equipped with a one-sided plane flat area which is in alignment with the surface of the cutter shaft, and that the conical or screw-shaped surfaces of the crowns (26) form a guide surface which turns the crowns (26) upon engagement with the drill pipe (16) in such a manner that the flat area is turned toward the drilling pipe (16).

7. The drilling device in accordance with claim 6 characterized in that the cutting tools (23,24) are arranged with an outwardly diverging tilt.

8. A drilling device which may be lowered into a drilled hole to be driven into hard stone, particularly rock, consisting of a drive means, a drill which is rotated by the drive means and a clamping device which engagable with the inside wall of the drilled hole and/or the inside wall of the piping, and which serves to transfer the torque of the drive means to the drill wherein the drive means, the drill and the clamping device are connected as one unit which may be fastened to the cable of a hoist or a drilling linkage with the drill being axially movable relative to the drilling pipe over a range corresponding with one working stroke and contrary to the clamping device characterized in that the drill comprises a ring-shaped housing (1), the outside diameter of which corresponds with the diameter of the drilled hole, a top plate, several cutting tools (2,23,24) installed in the top plate at equal distances from each other, parallel with the longitudinal axis of the drilling device, and serving to free a drilling core and bore crowns (3,26) mounted on the cutting tools which produce impact impulses in an axial direction and/or additional rotary movement by way of additional drive means, the pipe-shaped housing (1) containing the cutting tools (23,24) including a centered ring (31) which can be engaged with the bottom of the drill hole, a subsequent sediment housing (28) closable with a ball (29) and a carrying housing (27) connecting to the sediment housing and having a smaller diameter, and that the cutting tools (23,24) are arranged in a longitudinally movable manner in the part of the housing (1) which contains the sediment container (28) and contain at their free ends a housing (25) which carries the drive means for the cutting tools (23,24) with the housing being connected with the linkage (6*a*) via flexible lines (7*a*).

9. The drilling device in accordance with claim 8 characterized in that the drive means (13) of the pipe-shaped housing (1) is firmly connected with the strips of housing (12*a*) of the clamping device (12,14) with these strips serving to guide the housing.

* * * * *